US005281894A

United States Patent [19]

Bergeron et al.

[11] Patent Number: 5,281,894

[45] Date of Patent: Jan. 25, 1994

[54] DUAL CAVITY FOR A DUAL FREQUENCY GYROTRON

[75] Inventors: George Bergeron, Springfield, Va.; Max Rhinewine, Bethesda, Md.

[73] Assignee: The United States of America as represented by the Secretary of the Navy, Washington, D.C.

[21] Appl. No.: 589,752

[22] Filed: Sep. 28, 1990

[51] Int. Cl.[5] ..... H01Q 25/00

[52] U.S. Cl. ..... 315/5.43; 331/79

[58] Field of Search ..... 315/4, 5, 5.43, 5.46, 315/5.53, 5.35; 331/79, 83, 90

[56] References Cited

U.S. PATENT DOCUMENTS

| | | | |
|---|---|---|---|
| 2,897,455 | 7/1959 | Jones et al. | 315/5.53 X |
| 3,155,868 | 11/1964 | Fujii | 315/5.43 |
| 3,292,239 | 12/1966 | Sadler | 315/5 X |
| 4,209,755 | 6/1980 | Busacca et al. | 331/83 |
| 4,397,025 | 8/1983 | Kebabian | 372/37 |
| 4,531,076 | 7/1985 | Holder | 315/4 |
| 4,800,322 | 1/1989 | Symons | 315/5.39 |

FOREIGN PATENT DOCUMENTS

| | | | |
|---|---|---|---|
| 82769 | 6/1983 | European Pat. Off. | 315/5 |

OTHER PUBLICATIONS

Read, M. E., et al.; "Spatial and Temporal Coherence of a 35-GHz Gryomontron Using the $TE_{01}$ Mode"; IEEE Trans on Microwave Circular Theory & Techniques; vol. MTT-28, No. 8; Aug. 1980, pp. 875-878.

George Bergeron, Mark Czarnaski and Max Rhinewine, "Scaling of 85 $GH_z$ gyrotron to operate at 94 $GH_z$", Int. J. Electronics, 1990, vol. 69, No. 2, 281-290.

M. Rhinewine, and M. E. Read, "A $Te_{1,3}$ Gyrotron at 85 $GH_z$, Int. J. Electronics, 1986", vol. 61, No. 6, 729-733.

*Primary Examiner*—Benny T. Lee

*Attorney, Agent, or Firm*—Thomas E. McDonnell; Edward F. Miles

[57] ABSTRACT

A gyrotron providing first and second microwave frequencies comprises a dual frequency cavity coupled between an electron gun and a waveguide. The electron gun, the dual frequency cavity and a segment of the waveguide are surrounded by a variable magnetic source having first and second operating states. The first state provides microwaves at the first frequency, while the second state produces microwaves at the second frequency.

9 Claims, 2 Drawing Sheets

DUAL CAVITY FOR A DUAL FREQUENCY GYROTRON

FIELD OF THE INVENTION

The present invention relates generally to a microwave source, and, more specifically, to a gyrotron providing microwaves at two widely separated frequencies.

BACKGROUND OF THE INVENTION

Cyclotron masers, commonly referred to as gyrotrons, are used to produce high power, narrow bandwidth, modally pure microwaves. Conventional cavity structures used in gyrotrons limit the operating frequency range of the gyrotron to a single frequency, or a very narrow frequency range. Gyrotrons with operating frequencies of 35 gigahertz (GHz) and 94 Ghz are common, since these frequencies produce low attenuation in the atmosphere. Producing two or more widely separated microwave frequencies normally requires using two or more independent gyrotrons, which greatly increases system costs due to the need for redundant components including electron guns, power supplies and magnets. Some reduction in cost is achieved by the use of two separate cavities, which is offset by an increased number of man hours needed to replace the various cavities.

SUMMARY OF THE INVENTION

Accordingly, the principal object of the present invention is to provide a gyrotron cavity which provides high power frequency pure, modally pure microwaves at a plurality of frequencies.

Another object of the present invention is to provide a gyrotron which provides at least two widely separated frequencies of microwaves at a lower cost than heretofore has been possible.

These and other objects and advantages are achieved in accordance with the present invention by a dual frequency gyrotron comprising an electron gun for providing electrons, a cavity for receiving the electrons and producing microwaves having first and second frequencies responsive to an applied magnetic field having first and second states, a waveguide, coupled at a first end to the cavity and at a second end to an output window, for directing the microwaves produced by the cavity at the first and second frequencies through the output window, and means for producing the magnetic field. In the present invention, the cavity comprises first and second cavity regions for producing the first and second microwave frequencies, respectively. The first and second regions are coupled at a combination input-output section, which acts as both the output section of the first cavity region and the cutoff section of the second cavity region.

BRIEF DESCRIPTION OF THE DRAWINGS

The preferred embodiments are described with reference to the drawings, in which like elements are denoted with like numbers, and in which.

DESCRIPTION OF THE PREFERRED EMBODIMENTS

Figure 1:
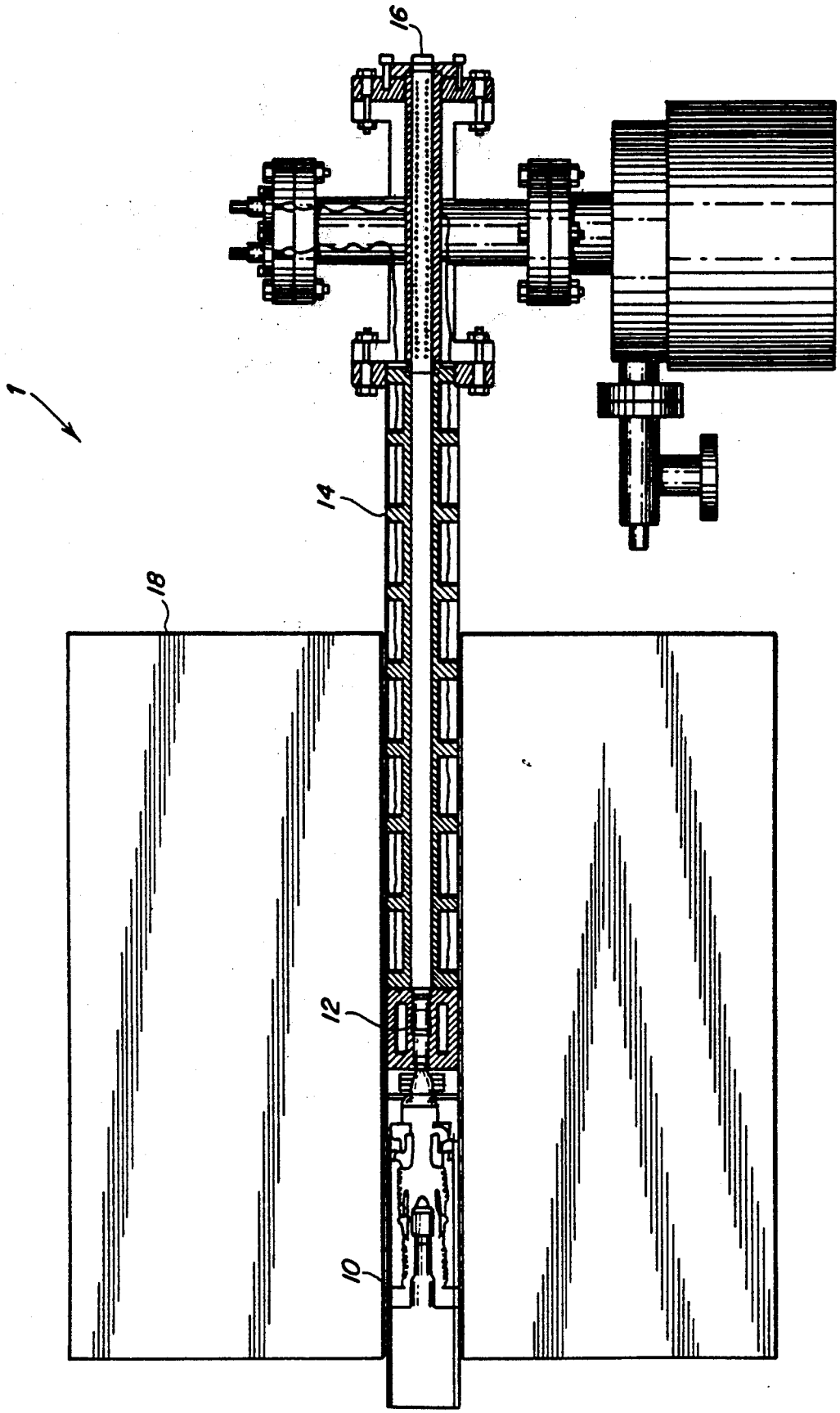
FIG. 1 is a schematic side view of a dual frequency gyrotron according to the present invention.

Referring to FIG. 1, a gyrotron 1 according the present invention comprises an electron gun 10 for producing a dense stream of electrons having a uniform velocity; a dual frequency cavity 12, which is coupled to gun 10 for producing microwaves at first and second frequencies; and a waveguide 14 which is coupled to the output of cavity 12 for directing the microwaves to an output window 16. Gun 10, cavity 12 and a portion of waveguide 14 are surrounded by a variable magnetic source 18, which is powered by a conventional power supply (not shown). Preferably, gun 10 and waveguide 14 are both conventional. Window 16 advantageously transmits microwaves at both first and second frequencies.

Figure 2:
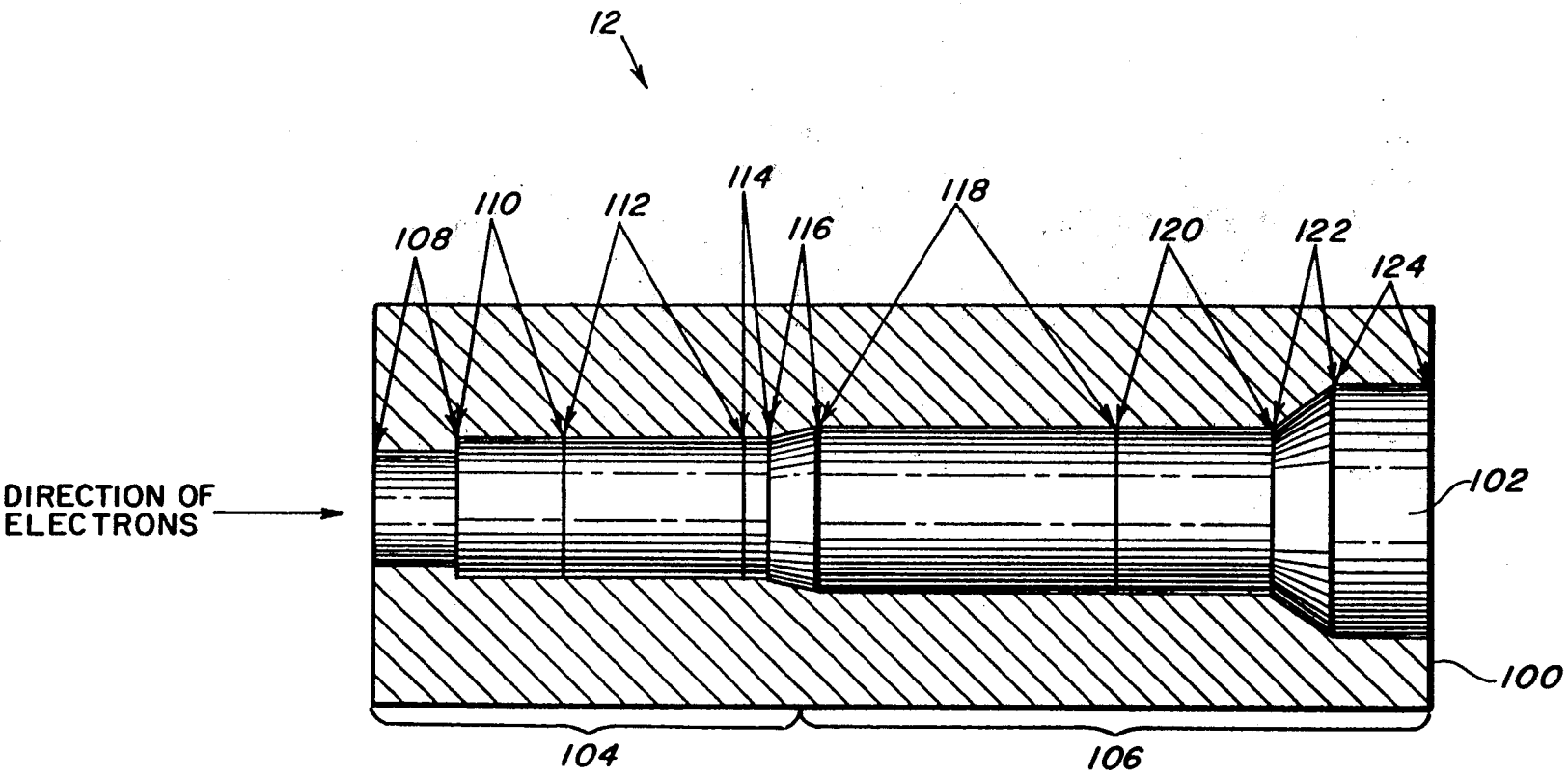
FIG. 2 is a schematic cross-sectional side view of a dual frequency cavity used in the gyrotron shown in FIG. 1.

Referring to FIG. 2, cavity 12 is formed from a cylinder 100 having a bore 102. Bore 102 advantageously has a plurality of sections of varying i.e., differing diameters, with each change in diameter defining a section of cavity 12. In the preferred embodiment, cavity 12 comprises a first region 104 coupled to gun 10 for generating microwaves at the first frequency, and a second region 106, coupled at one end to first region 104 and at the other end to waveguide 14, for generating microwaves at the second frequency. The design of single resonant cavities is well known, and one skilled in the art know how to produce a cavity such as 104, or one such as 106, for a single desired frequency.

As an example, first region 104 can comprise a high frequency cutoff section 108 having a radius of 0.362 centimeters (cm) and a length of 0.5 cm; an input tapered section 110 with a radius varying from 0.426 to 0.435 cm over a length of 0.677 cm; a resonant section 112 with a radius of 0.435 cm and a length of 1.173 cm; an output tapered section 114 with a radius varying from 0.435 cm to 0.451 cm over a length of 0.162 cm; and a combination input-output section 116 with a radius which varies from 0.451 cm to 0.518 over a length of 0.282 cm. Second region 106 can comprise section 116; an input tapered section 118 having a radius which varies from 0.518 cm to 0.530 cm over a length of 1.887 cm; a resonant section 120 with a radius of 0.530 cm and a length of 0.970 cm; an output tapered section 122 with a radius varying from 0.530 cm to 0.801 cm over a length of 0.373 cm; and an output section 124 with a radius of 0.801 cm and a length of 4.0 cm. Thus, section 116 provides both the output section of first region 104 and the input section of second region 106. Section 116 advantageously is the cutoff aperture of second region 106, which has a cutoff frequency which is less than the first frequency.

In the preferred embodiment, first region 104 comprises a cavity operating at a low order transverse electromagnetic (TEM) mode, e.g., $TE_{13}$, at 94 gigahertz (Ghz), while second region 106 is a cavity operating in a $TE_{01}$ mode at 35 GHz. Thus, cavity 12 provides frequency pure, modally pure microwaves at both 35 GHz and 94 GHz, as discussed in detail below. The dimensions of cavity 12 advantageously are selected to provide large wall radii in the various sections, thus producing a low power density in cavity 12 so as to prevent cavity heating and arcing.

During operation of gyrotron 1, the output frequency is controlled by variable source 18, which advantageously provides a variable magnetic field having at least first and second states. Conventional gyrotrons use a magnetic source to focus the electron beam from an electron source in the resonant area of a conventional cavity. The first state of source 18 advantageously produces microwaves at the first frequency by focusing the electrons travelling through gyrotron 1 in first region 104. The second state of source 18 provides microwaves at the second frequency by concentrating electron flow through gyrotron 1 in second region 106. Thus, the output frequency of gyrotron 1 is switched between the first and second frequencies by changing the state of source 18, which could be a variable source. Preferably, the magnetic field strength of the first state is greater than the field strength of the second state of source 18.

It will be appreciated that dual frequency gyrotrons with other operating frequencies can be produced from a pair of cavities where the output section of one cavity has the cutoff diameter of the other cavity.

Other modifications and variations to the invention will be apparent to those skilled in the art from the foregoing disclosure and teachings. Thus, while only certain embodiments of the invention have been specifically described herein, it will be apparent that numerous modifications may be made thereto without departing from the spirit and scope of the invention.

What is claimed is:

1. A gyrotron comprising:

a cavity section, said cavity section comprising a first resonant portion, and a second resonant portion, said second resonant portion adapted to have an upper cutoff frequency less than or equal to the lower cutoff frequency of said first resonant portion;

means for directing a flow of electrons through said cavity section;

means for disposing a magnetic field in said cavity section substantially along said flow of electrons;

said means for disposing being effective to cause said field to have two intensities, one of said intensities being selected to cause electrons in said flow to have a gyro-frequency effective to cause said first resonant portion to resonate at a frequency greater than said cutoff frequency, and the other of said intensities being selected to cause electrons in said flow to have a gyro-frequency effective to cause said second resonant portion to resonate at a frequency less than said cutoff frequency.

2. A dual frequency gyrotron comprising:

an electron gun for providing a flow of electrons;

magnetic field means for producing a magnetic field, said magnetic field having first and second intensities; and wherein said gyrotron further comprises:

a first cavity region for producing microwaves at a first frequency a second cavity region for producing microwaves at a second frequency, said second cavity region having an upper cutoff frequency less than or equal to the lower cutoff frequency of said first cavity region; and means effective to selectively cause: (1) said magnetic field means to direct said magnetic field at said first intensity to said flow of electrons, effective to produce electromagnetic gyro-radiation at said first cavity region effective to cause said first cavity to produce said microwaves at said first frequency, and (2) said magnetic field means to direct said magnetic field at said second intensity to said flow of electrons, effective to produce electromagnetic gyro-radiation at said second cavity region effective to cause said second cavity to produce said microwaves at said second frequency.

3. The dual frequency gyrotron of claim 2, wherein said first and second frequencies are 94 Ghz and 35 GHz, respectively.

4. A dual frequency gyrotron having an electron gun for producing a flow of electrons comprising:

a first cavity region for generating microwaves at a first frequency;

a second cavity region operatively coupled to said first cavity region for generating microwaves at a second frequency; and magnetic field means for producing a magnetic field at a first and a second field intensity, said first intensity being effective to cause said microwaves at said first frequency to be generated by resonant gyro-coupling between said flow of electrons and said first cavity region, and said second field intensity being effective to cause said microwaves at said second frequency to be generated by resonant gyro-coupling between said flow of electrons and said second cavity region.

5. The dual frequency cavity of claim 4, wherein said first field intensity is greater than that of said second field intensity.

6. The gyrotron of claim 4, wherein said first and second cavity regions are formed from a single cylinder having a bore, said bore having a plurality of sections with differing diameters for producing said microwaves at said first and second frequencies.

7. The dual frequency cavity of claim 6, wherein said first and second frequencies are 94 GHz and 35 GHz, respectively.

8. The dual frequency cavity of claim 4, wherein said first and second frequencies are 94 GHz and 35 GHz, respectively.

9. The dual frequency cavity of claim 4, wherein said cavity further comprises a combination input-output section having a first end coupled to an output tapered section of said first cavity region and having a second end coupled to an input tapered section of said second cavity region.

* * * * *